US011851731B2

(12) United States Patent
Bez et al.

(10) Patent No.: US 11,851,731 B2
(45) Date of Patent: Dec. 26, 2023

(54) HIGHLY TUNABLE, INEXPENSIVE AND EASILY FABRICATED MAGNETOCALORIC MATERIALS

(71) Applicant: Iowa State University Research Foundation, Inc., Ames, IA (US)

(72) Inventors: Henrique Neves Bez, Santa Catarina (BR); Anis Biswas, Ames, IA (US); Arjun K. Pathak, Ames, IA (US); Yaroslav Mudryk, Ames, IA (US); Nikolai A. Zarkevich, Ames, IA (US); Viktor Balema, Ames, IA (US); Vitalij K Pecharsky, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 1046 days.

(21) Appl. No.: 16/350,728

(22) Filed: Dec. 20, 2018

(65) Prior Publication Data

US 2019/0214169 A1 Jul. 11, 2019

Related U.S. Application Data

(60) Provisional application No. 62/708,912, filed on Dec. 28, 2017.

(51) Int. Cl.
*C22C 1/02* (2006.01)
*C22C 30/00* (2006.01)
(Continued)

(52) U.S. Cl.
CPC ..... *C22C 1/023* (2013.01); *C21D 8/1211* (2013.01); *C22C 1/02* (2013.01); *C22C 1/0433* (2013.01);
(Continued)

(58) Field of Classification Search
CPC ..... C21D 8/1211; H01F 1/012; H01F 1/015; C22C 1/02; C22C 1/023; C22C 1/0433;
(Continued)

(56) References Cited

U.S. PATENT DOCUMENTS

2016/0256923 A1* 9/2016 Liu ..... C21D 1/84

FOREIGN PATENT DOCUMENTS

CN 1244735 A * 2/2000
JP 06306505 A * 11/1994 ..... H01M 4/383

OTHER PUBLICATIONS

Qu et al. "Giant and reversible room-temperature magnetocaloric effect in Ti-doped Ni—Co—Mn—Sn magnetic shape memory alloys", Jun. 8, 2017, Acta Materialia, vol. 134, pp. 236-248 (Year: 2017).*

(Continued)

*Primary Examiner* — Sally A Merkling
*Assistant Examiner* — Dean Mazzola

(57) ABSTRACT

A method is provided of making a magnetocaloric alloy composition comprising Ni, Co, Mn, and Ti, which preferably includes certain beneficial substitutional elements, by melting the composition and rapidly solidifying the melted composition at a cooling rate of at least 100 K/second (Kelvin/second) to improve a magnetocaloric property of the composition. The rapidly solidified composition can be heat treated to homogenize the composition and annealed to tune the magneto-structural transition for use in a regenerator.

6 Claims, 13 Drawing Sheets

(51) Int. Cl.

| | |
|---|---|
| ***H01F 1/01*** | (2006.01) |
| ***C21D 8/12*** | (2006.01) |
| ***C22F 1/10*** | (2006.01) |
| ***C22C 19/00*** | (2006.01) |
| ***C22C 19/03*** | (2006.01) |
| ***C22C 30/06*** | (2006.01) |
| ***C22C 30/02*** | (2006.01) |
| ***C22C 1/04*** | (2023.01) |

(52) U.S. Cl.
CPC ..... *C22C 19/005* (2013.01); *C22C 19/03* (2013.01); *C22C 30/00* (2013.01); *C22C 30/02* (2013.01); *C22C 30/06* (2013.01); *C22F 1/10* (2013.01); *H01F 1/015* (2013.01); *C22C 2202/02* (2013.01)

(58) Field of Classification Search
CPC ..... C22C 19/005; C22C 19/03; C22C 30/00; C22C 30/02; C22C 30/06; C22C 2202/02; C22F 1/10
See application file for complete search history.

(56) References Cited

OTHER PUBLICATIONS

Jian, Liu "Optimizing and fabricating magnetocaloric materials", Mar. 20, 2014, Chinese Physics B, vol. 23, No. 4 (Year: 2014).*
Z. Y. Wei et al, Realization of multifunctional shape-memory ferromagnets in all-d metal-Heusler phases, Applied Physics Letters, 107, 022406, 2015.
Z. Y. Wei et al, Magnetostuctual martensitic transformations with large volume changes and magneto-strains in all-d metal Heusler alloys, Applied Physics Letters, 109,071904,2016.

* cited by examiner

HIGHLY TUNABLE, INEXPENSIVE AND EASILY FABRICATED MAGNETOCALORIC MATERIALS

RELATED APPLICATION

This application claims benefit and priority of provisional application Ser. No. 62/708,912 filed Dec. 28, 2017, the entire disclosure and drawings of which are incorporated herein by reference.

ORIGIN OF THE INVENTION

This invention was made with government support under Grant No. DE-AC02-07CH11358 awarded by the Department of Energy. The government has certain rights in the invention.

FIELD OF THE INVENTION

The present invention relates to magnetocaloric materials useful for magnetic refrigeration and to a method of manufacturing such materials.

BACKGROUND OF THE INVENTION

Magnetic cooling has been proposed as a highly energy efficient method of solid-state refrigeration aiming to avoid environmentally hazardous gasses used in the conventional vapor compressor systems [reference 1]. The original magnetic refrigeration prototype system operated using metallic Gd, which has magnetic transition at room temperature [reference 2]. However, Gd is expensive and needs high magnetic field to allow a high coefficient of performance (COP). In 1997, it was shown that a $Gd_5Si_2Ge_2$ material combining a structural and magnetic transition exhibits a much larger magnetocaloric effect than Gd [reference 3]. However, the $Gd_5Si_2Ge_2$ material contains even a more expensive raw material Ge for preparation. Since then, there has been a significant effort to develop better and cheaper alloys to make magnetic cooling a viable technology.

Magnetocaloric materials exhibit the so-called magnetocaloric effect, which is a thermal response of the material when subject to an external applied magnetic field change. Such effect may be used to develop refrigeration systems that function on solid state without need of hazardous gases and with higher theoretical efficiency when compared to the conventional vapor-compression systems. The magnetocaloric effect is most prominent close to large magnetization changes in respect to the temperature, i.e. at magnetic transitions. Different magnetic transitions may lead to large magnetocaloric effects: ferromagnetic (FM) to paramagnetic (PM); antiferromagnetic (AFM) to FM; spin glass to FM; etc. Among the different transitions, a few materials stand out, such as La—Fe—Si [reference 4] alloys, $Fe_2P$-based materials [reference 5], and Heusler alloys [reference 6]. Nonetheless, these materials still do not allow the commercialization of the technology, as they do not fulfill all of the requirements for a magnetic regenerator entirely; namely, mechanical integrity, large magnetocaloric effect in low magnetic field, shapeability, adequate thermal properties (e.g. heat capacity and thermal conductivity), abundant, inexpensive and non-toxic constituent elements.

Many attempts have been made, and many magnetocaloric materials have been developed, such as $La(Fe,Si)_{13}$ and related alloys, and their hydrides, $Fe_2P$-based compounds, and Heusler alloys. Still, all of them have one or more of the following issues: the need to hydrogenate to adjust magnetic ordering temperature, presence of critical/expensive/toxic materials (such as rare-earth elements, or Ge, In, Ga, P, As, Sb, Sc, Nb, among others); small magnetocaloric effect; Curie temperature, $T_C$, far from the desired temperature of operation; expensive processing; inherent mechanical brittleness.

In 2015 a $Ni_{50-x}Co_xMn_{35}Ti_{15}$ material, where x was varied from 0 to 17, with tunable $T_C$ and B2-type crystal structure was reported [reference 7]. All constituent elements are d-metals and are relatively abundant, cheap and non-toxic. The material has been prepared by arc melting/induction melting followed by heat treatment up to six days at temperatures as high as 1173 K. Such long time at high temperature means that the fabrication of the material by this method is cumbersome and expensive. Even more detrimental is the fact that the material may not be chemically/structurally homogeneous because powder x-ray diffraction (XRD) peaks of the main B2-type (also known as CsCl-type) phase are broad. Moreover, even though the material shows a magneto-structural transition, the reported entropy change [reference 7] is not much larger compared to Gd which can also be related to significant chemical/structural inhomogeneity [reference 8].

SUMMARY OF THE INVENTION

An aspect of the present invention involves a Ni—Co—Mn—Ti—Z alloy composition, where Z is an optional substitutional element selected from the group consisting of Fe, V, Sc, Zr, Nb, Mo, Zn, and Cu, where the composition is produced by a combination of method steps that yield a large magnetocaloric effect and improved mechanical integrity. The magneto-structural transition temperature can be controlled by composition and finely tuned by heat-treatments, which, however, are optional and not required.

Embodiments of the present invention involve the rapid solidification of certain Ni—Co—Mn—Ti alloy compositions with surprisingly large magnetocaloric effect and highly tunable transitions. For purposes of illustration and not limitation, an illustrative embodiment of the present invention involves melting and rapidly solidifying the alloy composition by melt spinning, splat quenching, atomization or other rapid solidification process producing a cooling rate of at least 100 K/second (Kelvin/second) to manufacture a highly chemically homogeneous rapidly solidified material. Melt spun ribbons can be made pursuant to the invention and exhibit a magnetocaloric effect at room temperature that is about three to four times more than that of similar materials that are not rapidly solidified pursuant to embodiments of the invention. Other methods of rapid solidification of the molten composition can be utilized including, but not limited to, gas atomization, selective laser melting, and additive manufacturing (3D printing).

The rapidly solidified material may then be optionally heat-treated in order to crystallize possible remains of amorphous material and/or release internal stress after the rapid quenching. Moreover, annealing of the ribbons at different temperatures allows control of the transition temperature and thus operation temperature of magnetic refrigeration material.

The present invention also envisions in still another aspect a magnetic regenerator comprising at least one component, typically multiple components, such as one or more layers comprising at least one of particulates of various shapes, a spheroid body(ies), a sheet(s), and plate(s) having the same composition, but annealed at different temperatures to provide different magneto-structural transition temperatures for use in the operation of the regenerator. Also envisioned is a magnetic regenerator having different substituted compositions, such as those set forth below, to provide different magneto-structural transition temperatures for use in the operation of the regenerator.

Another still further aspect of the present invention involves chemical modification of the Ni—Co—Mn—Ti alloys by substitution of at least one of Fe, Cr, V, Sc, Zr, Nb, Mo, Zn, and Cu for another alloying element in a manner to tune the magneto-structural transition temperature of the rapidly solidified material.

In an illustrative embodiment of the invention, the following chemically modified alloy compositions are envisioned:

$Ni_{37.5}Co_{12.5-x}Fe_x\ Mn_{35}Ti_{15}$ with $0<x<12.5$;
$Ni_{37.5-x}Fe_xCo_{12.5}Mn_{35}Ti_{15}$ with $0<x<37.5$;
$Ni_{37.5-x}Cu_x\ Co_{12.5}Mn_{35}Ti_{15}$ with $0<x<37.5$;
$Ni_{37.5-x}Zn_x\ Co_{12.5}Mn_{35}Ti_{15}$ with $0<x<37.5$;
$Ni_{37.5}Co_{12.5}Mn_{35-x}\ Fe_xTi_{15}$ with $0<x<35$;
$Ni_{37.5}Co_{12.5}Mn_{35-x}\ Cr_xTi_{15}$ with $0<x<35$;
$Ni_{37.5}Co_{120.5}Mn_{35-x}\ Mo_xTi_{15}$ with $0<x<35$;
$Ni_{37.5}Co_{12.5}Mn_{35}\ Ti_{15-x}V_x$ with $0<x<15$;
$Ni_{37.5}Co_{12.5}Mn_{35}Ti_{15-x}Zr_x$ with $0<x<15$;
$Ni_{37.5}Co_{12.5}Mn_{35}Ti_{15-x}Sc_x$ with $0<x<15$; and
$Ni_{37.5}Co_{12.5}Mn_{35}Ti_{15-x}Nb_x$ with $0<x<15$;

Other advantages and details with respect to certain illustrative embodiments of the present invention will be described below in relation to the following drawings for purposes of illustration and not limitation.

DETAILED DESCRIPTION OF THE INVENTION

Figure 1:
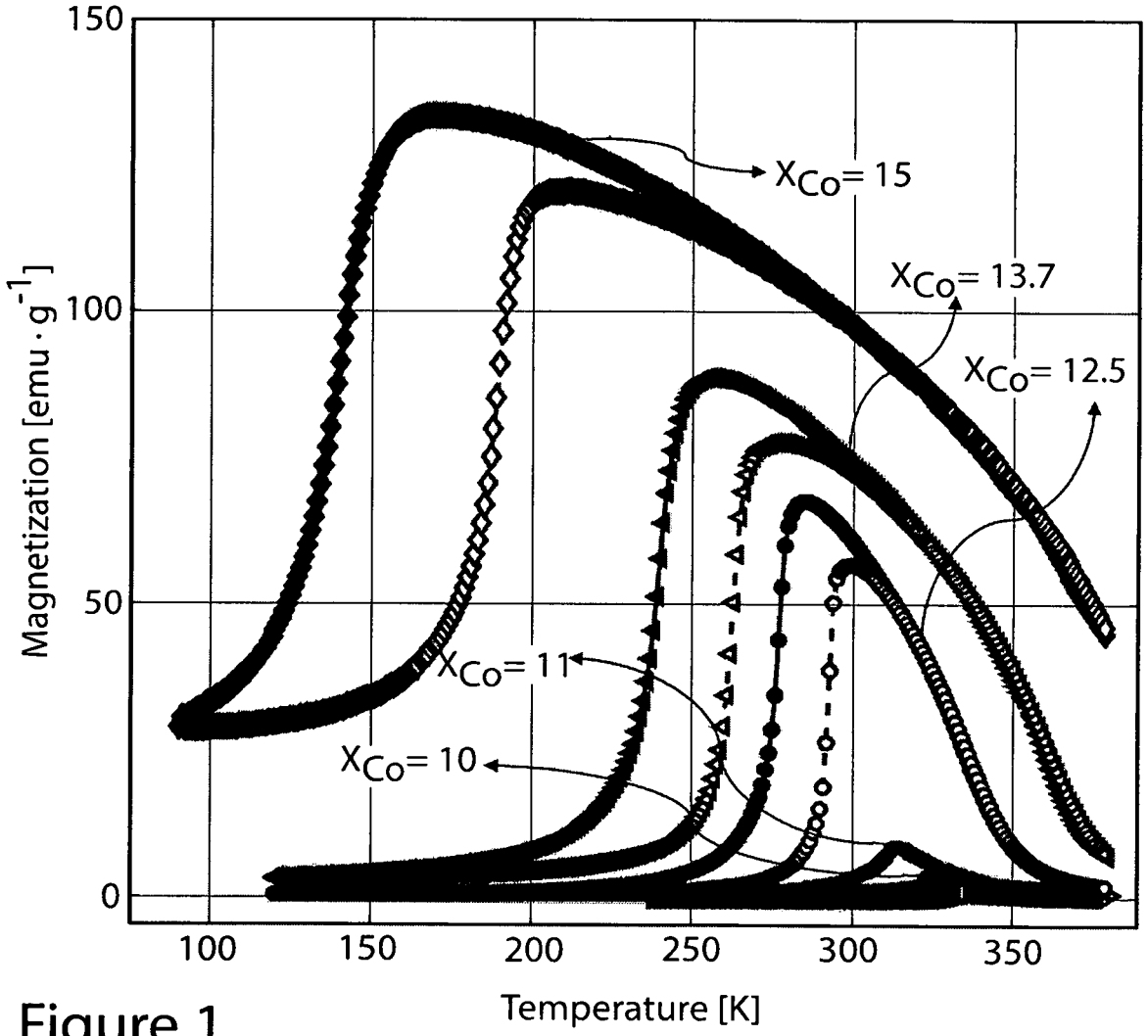
FIG. 1 shows isofield magnetization measurements of different compositions of rapidly solidified by melt spinning $Ni_{50-x}Co_xMn_{35}Ti_{15}$ ribbons (without heat treatments) measured at a constant magnetic field of 0.1 T. Filled (solid) symbols show magnetization measured during cooling, and open symbols show magnetization measured during heating.

Embodiments of the present invention relate to certain magnetocaloric materials that exhibit the so-called magnetocaloric effect (MCE), which is a thermal response of the material when subject to an external applied magnetic field change. The magnetocaloric effect is most prominent close to large magnetization changes in respect to the temperature, i.e. at magnetic transitions. Different magnetic transitions may present a large magnetocaloric effect: ferromagnetic (FM) to paramagnetic (PM); antiferromagnetic (AFM) to FM; spin glass to FM; etc.

The present invention embodies improvements to Ni—Co—Mn—Ti alloys, as well as to a method for their fabrication. Such alloys exhibit a martensitic to austenitic transition with crystal symmetry and magnetic structure (AFM in the austenite phase and FM in the martensite phase) changes followed by a FM to PM transition without crystal symmetry change, where the martensitic transition temperature, $T_M$, is lower than the Curie temperature, $T_C$. Hence, below $T_M$, the alloys are in the AFM austenite, and above $T_M$ but below $T_C$ they are FM martensite.

An aspect of the present invention involves a Ni—Co—Mn—Ti alloy composition produced by rapid solidification followed by optional heat treatment and annealing steps that yield a large magnetocaloric effect. The alloy composition is formulated by abundant, cheap and easily processed elements with good mechanical integrity; in particular, the Ni—Co—Mn—Ti alloy compositions preferably are chemically modified by substitution of at least one of Fe, Cr, V, Sc, Zr, Nb, Mo, Zn, and Cu for another alloying element in a manner to tune the magneto-structural transition temperature of the rapidly solidified material. The magneto-structural transition temperature of the modified alloy composition may be controlled by composition and/or finely tuned by heat-treatments and/or optional application of hydrostatic pressure.

Illustrative embodiments of chemically modified alloy compositions pursuant to embodiments of the invention include, but are not limited to, the following compositions:

$Ni_{37.5}Co_{12.5-x}Fe_x Mn_{35}Ti_{15}$ with $0<x<12.5$;
$Ni_{37.5-x}Fe_xCo_{12.5}Mn_{35}Ti_{15}$ with $0<x<37.5$;
$Ni_{37.5-x}Cu_x Co_{12.5}Mn_{35}Ti_{15}$ with $0<x<37.5$;
$Ni_{37.5-x}Zn_x Co_{12.5}Mn_{35}Ti_{15}$ with $0<x<37.5$;
$Ni_{37.5}Co_{12.5}Mn_{35-x}Fe_xTi_{15}$ with $0<x<35$;
$Ni_{37.5}Co_{12.5}Mn_{35-x} Cr_xTi_{15}$ with $0<x<35$;
$Ni_{37.5}Co_{12.5}Mn_{35-x}Mo_xTi_{15}$ with $0<x<35$;
$Ni_{37.5}Co_{12.5}Mn_{35} Ti_{15-x} V_x$ with $0<x<15$;
$Ni_{37.5}Co_{12.5}Mn_{35}Ti_{15-x}Zr_x$ with $0<x<15$;
$Ni_{37.5}Co_{12.5}Mn_{35}Ti_{15-x}Sc_x$ with $0<x<15$; and
$Ni_{37.5}Co_{12.5}Mn_{35}Ti_{15-x}Nb_x$ with $0<x<15$;

An illustrative processing method involves arc-melting the elemental components of the alloy composition in the correct stoichiometry with an excess of 3.5 wt. % Mn to account for its loss due to evaporation during arc melting. The excess of Mn may vary, depending on the type of equipment employed, the overall quantity of the alloy, and the atmosphere in which the melting is performed. The solidified material is then (optional step) drop-cast from a high temperature molten state to form a more chemically homogeneous casting. The casting is then remelted and rapidly solidified; for example, using melt-spinning, splat cooling or atomization. For example, the melt-spun ribbons are prepared using induction melting of ingots in a quartz crucible under 250 torr pressure of high purity helium gas and then ejected at 105 torr overpressure of the helium gas at 1473 K onto a copper chill wheel rotating at a tangential speed of about 20 m/s in the helium gas, which are useful parameters of the melt-spinning technique. The parent B2-phase is easily formed and stable. Other methods of rapid solidification of molten alloy composition can be utilized including, but not limited to gas atomization, selective laser melting, and 3D printing.

The rapidly solidified alloys show an observed magnetic entropy change as high as 27 $J \cdot kg^{-1} \cdot K^{-1}$ at about room temperature for a magnetic field change of 2 T.

Following rapid solidification, the rapidly solidified alloy material may then be heat-treated (optional step) at a temperature and for a time to crystallize any possible remains of amorphous material and/or to release internal stress after the rapid quenching.

Adjusting of the martensitic-austenitic (structural) transition temperature is easily controlled by the stoichiometry of the composition or by heat treatment.

The rapidly solidified alloy material, or the heat treated alloy material from the preceding paragraphs, may be subjected to optional annealing heat treatment at different temperatures and times to closely control the magneto-structural transition temperature of the material and thus the operation temperature of magnetic refrigeration material.

The following examples are offered to further illustrate but not limit embodiments of the present invention:

EXAMPLES

Example 1: Rapid Solidification

Different compositions $Ni_{50-x} Co_xMn_{35}Ti_{15}$ with x indicated in Table 1 below were rapidly solidified as melt-spun ribbons prepared using a melt-spinning technique with the following range of operating parameters: induction melting of the ingot in a quartz crucible under 250 torr pressure of high purity helium gas and then ejected at 1473 K at 105 torr overpressure of the helium gas onto a copper chill wheel rotating at a tangential speed of about 20 m/s. Melt-spinning resulted in chemically homogenous materials with well-refined sub-micron size grains. The melt spun materials have a chemically homogenous microstructure or nanostructure.

TABLE 1

$Ni_{50-x}Co_xMn_{35}Ti_{15}$ Melt Spun Ribbons:

| Co concentration (x) | Transition Temperature on heating, $T_M$ (K) | Heat treatment temperature (K) | ΔS for ΔH = 2T ($J \cdot kg^{-1} \cdot K^{-1}$) |
|---|---|---|---|
| 10 | 334 | No treatment | |
| 11 | 322 | No treatment | |
| 12.5 | 288 | No treatment | 27.2 |
| 12.5 | 289 | 873 | |
| 12.5 | 289 | 973 | |
| 12.5 | 293 | 1073 | |
| 12.5 | 296 | 1173 | |
| 13.7 | 263 | No treatment | 17.7 |
| 15 | 189 | No treatment | 4.38 |

X-ray diffraction and magnetization measurements were performed on the series of these alloys, some prepared as-solidified ribbons and some as heat treated ribbons. Analysis of Table 1 above demonstrates that the martensitic AFM-FM transition temperature $T_M$ has been properly tuned to room temperature (see $T_M$ about 288-298 K for samples with x=12.5), with an extremely large magnetocaloric effect (here evaluated as entropy change, ΔS). In fact, the table shows one of the largest magnetocaloric effects ever reported for such a small field change and about three (3) times larger when compared to a material of the same series, $Ni_{50-x} Co_xMn_{35}Ti_{15}$, but not made by rapid solidification and instead by usual melting techniques such as arc-melting followed by several days of heat treatment at high temperature, as reported by Wei et al [reference 7].

Example 2: Rapid Solidification of Chemically Substituted Compositions

Different compositions of substituted Ni—Co—Mn—Ti alloys were prepared as follows:

$Ni_{37.5-y}T'_yCo_{12.5}Mn_{35}Ti_{15}$, where T'=Cu or Fe with $0<y<5$; and $Ni_{37.5}Co_{12.5-y}Fe_yMn_{35}Ti_{15}$, with $0<y<5$.

The fabrication was conducted with high purity elements being weighed stoichiometrically (with 3.5 wt. % of Mn in excess to account for Mn evaporation) and then arc-melted, followed by drop-casting and melt-spinning. The latter was performed induction melting of the ingot in a quartz crucible under 250 tor pressure of high purity helium gas and then ejected at 105 torr overpressure at 1473 K onto a copper chill wheel rotating at a tangential speed of about 20 m/s.

The compositional accuracy and single phase were verified with scanning electron microscopy and energy dispersive analysis (SEM and EDX, respectively). The single phase was also verified via x-ray diffraction (XRD) analysis at room temperature.

Heat treatment experiments were performed by sealing the material under vacuum in a quartz tube and holding the melt-spun ribbons at different temperatures for 30 min, then quenched in ice-water. To compare with conventional processing [reference 7], some of the samples were cut after drop-casting, and a separate piece was heat-treated at 1073 K under vacuum for 7 days without the rapid solidification processing. Isofield magnetization measurements were carried out in a Quanta Design Physical Property Measurement System (QD-PPMS) with a vibrating sample magnetometer insert. The calculation of entropy change was done by using isofield magnetization measurements performed at 1 $K \cdot min^{-1}$. Temperature dependent XRD measurements were executed on a Rigaku TTRAX rotating anode powder diffractometer employing Mo Kα radiation [reference 9]. Rietveld refinements were performed using the Rietica software.

Martensitic phase transition features of different as-melt-spun ribbon $Ni_{37.5}Co_{12.5-y}Fe_yMn_{35}Ti_{15}$ and $Ni_{37.5-y}T'_yCo_{12.5}Mn_{35}Ti_{15}$ ($1<y<5$) samples upon heating are shown below:

TABLE 2

Martensitic phase transition features of different as-melt-spun ribbon $Ni_{37.5}Co_{12.5-y}Fe_yMn_{35}Ti_{15}$ and $Ni_{37.5-y}T'_yCo_{12.5}Mn_{35}Ti_{15}$ ($1 < y < 5$) samples.

| Sample | $T_M$ (heating) | $\Delta T_{hysteresis}$ (K) | ΔS (2T) [J $kg^{-1}$ $K^{-1}$] |
|---|---|---|---|
| $Ni_{37.5}Co_{11.5}Fe_1Mn_{35}Ti_{15}$ | 286 | 16 | — |
| $Ni_{37.5}Co_{9.5}Fe_3Mn_{35}Ti_{15}$ | 286 | 16 | — |
| $Ni_{37.5}Co_{7.5}Fe_5Mn_{35}Ti_{15}$ | 286.9 | 16 | — |
| $Ni_{35}Fe_{2.5}Co_{12.5}Mn_{35}Ti_{15}$ | 188.8 | 40.1 | — |
| $Ni_{32.5}Fe_5Co_{12.5}Mn_{35}Ti_{15}$ | ** | ** | — |
| $Ni_{35}Cu_{2.5}Co_{12.5}Mn_{35}Ti_{15}$ | 216.4 | 30.5 | 16.05 |
| $Ni_{32.5}Cu_5Co_{12.5}Mn_{35}Ti_{15}$ | ** | ** | — |

** Martensitic transition below 50 K (not observed)

Results of Examples 1 and 2

FIGS. 1 through 4 show isofield magnetization measurements of the as-melt-spun ribbons prepared without heat treatment. As one may see, each elemental substitution presents a different effect; $Ni_{37.5}Co_{12.5}Mn_{35}Ti_{15}$ shows a sharp magneto-structural transition around room temperature which is promising for magnetic refrigeration. Increase of Co content above x=12.5 leads to increase of thermal hysteresis and to the decrease of transition temperature $T_M$. Furthermore, the increase of Co content also leads to the decrease of the sharpness of the transition. When the Co content is reduced below x=12.5, the transition temperature $T_M$ increases, the hysteresis is slightly reduced.

Figure 2:
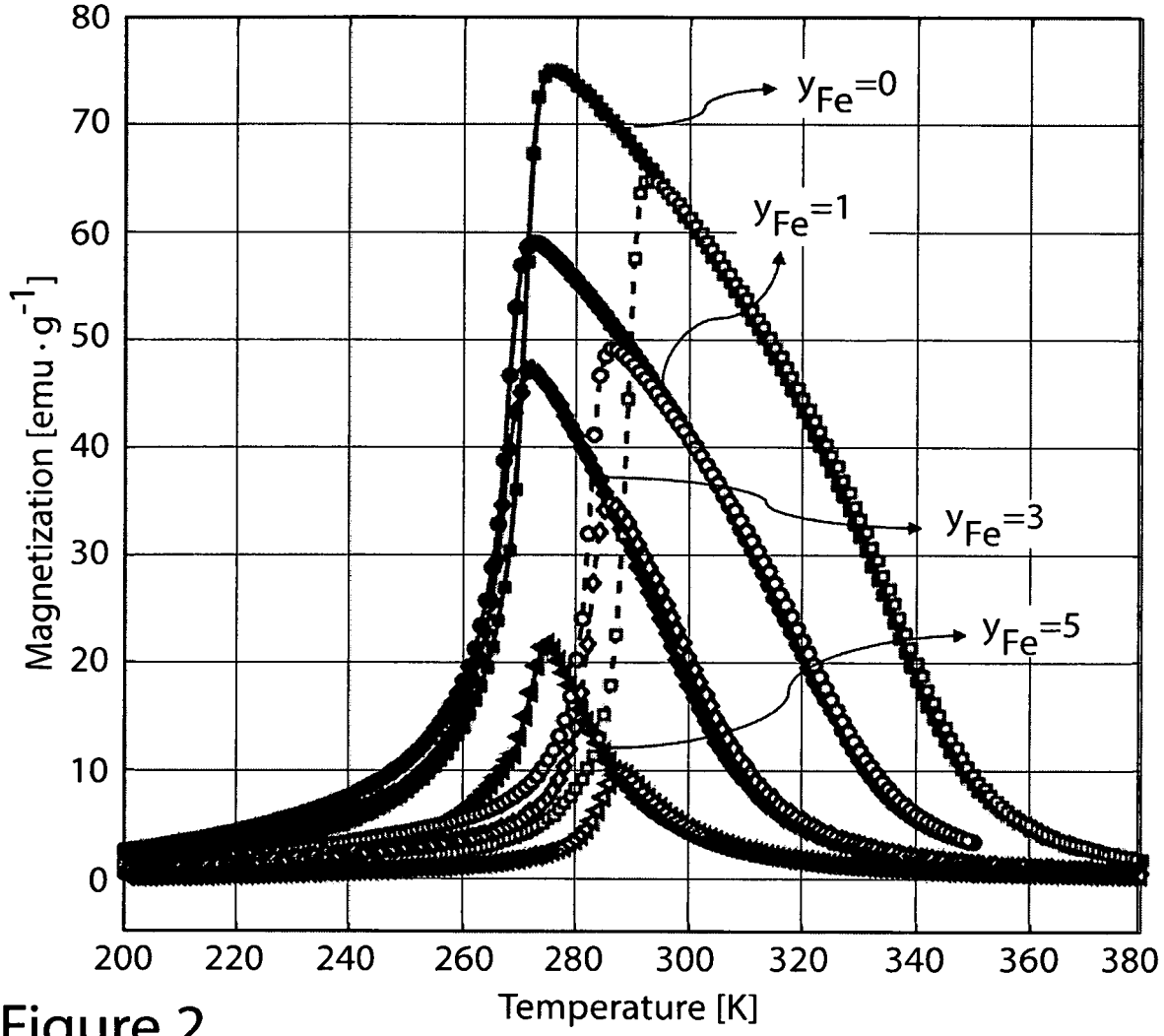
FIG. 2 shows isofield magnetization measurements of different compositions of rapidly solidified by melt spinning $Ni_{37.5}Co_{12.5-y}Fe_yMn_{35}Ti_{15}$ ribbons (without heat treatments) measured at a constant magnetic field of 0.1 T. Filled symbols show magnetization measured during cooling, and open symbols show magnetization measured during heating.

Chemically substituted alloy compositions, $Ni_{50-x}Fe_xMn_{35}Ti_{15}$ with x=5, 10, 13.5 (devoid of Co), were also synthesized but not shown in FIGS. 1 through 4 since these compositions did not show any magnetic transitions of interest, a consequence which can be extrapolated from FIG. 2.

Figure 3:
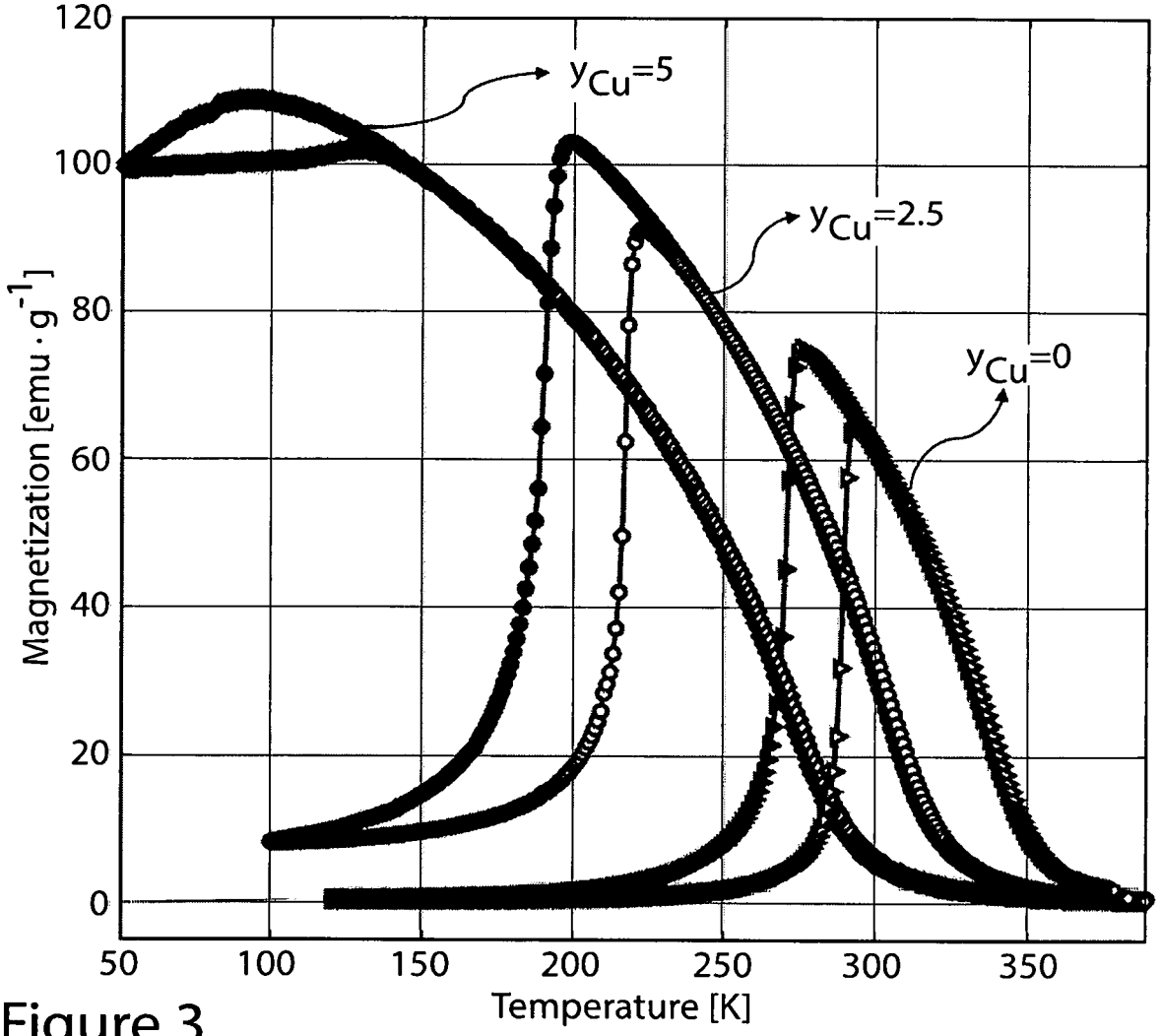
FIG. 3 shows isofield magnetization measurements of different compositions of rapidly solidified by melt spinning $Ni_{37.5-y}Cu_yCo_{12.5}Mn_{35}Ti_{15}$ ribbons (without heat treatments) measured at a constant magnetic field of 0.1 T. Filled symbols show magnetization measured during cooling, and open symbols show magnetization measured during heating.
Figure 4:
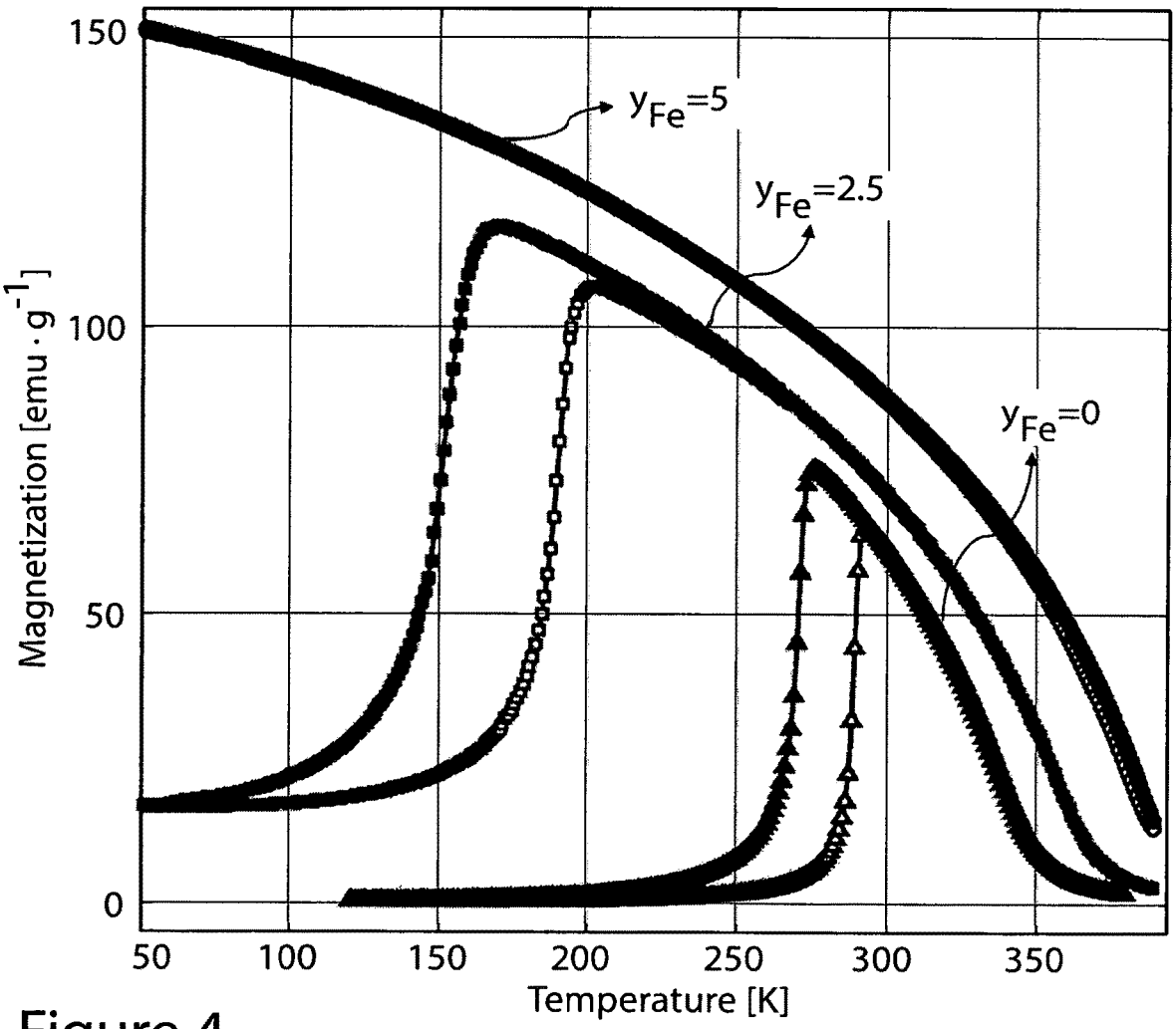
FIG. 4 shows isofield magnetization measurements of different compositions of rapidly solidified by melt spinning $Ni_{37.5-y}Fe_yCo_{12.5}Mn_{35}Ti_{15}$ ribbons (without heat treatments) measured at a constant magnetic field of 0.1 T. Filled symbols show magnetization measured during cooling, and open symbols show magnetization measured during heating.

However, Fe substitution in $Ni_{375-y}Fe_y$ $Co_{12.5}$ $Mn_{35}Ti_{15}$ further stabilizes the ferromagnetic B2 phase. Cu substitution in $Ni_{37.5-y}Cu_y$ $Co_{12.5}Mn_{35}Ti_{15}$ also stabilizes the FM phase as shown in FIG. 3, although (unlike the Fe substitution) Cu substitution decreases the $T_M$ as well. Moreover, Cu substitution seems to have a lesser effect on the sharpness of the transition, when compared to Co contents higher than 12.5, which consequently leads to large magnetocaloric effect as will be shown later.

Figure 5:
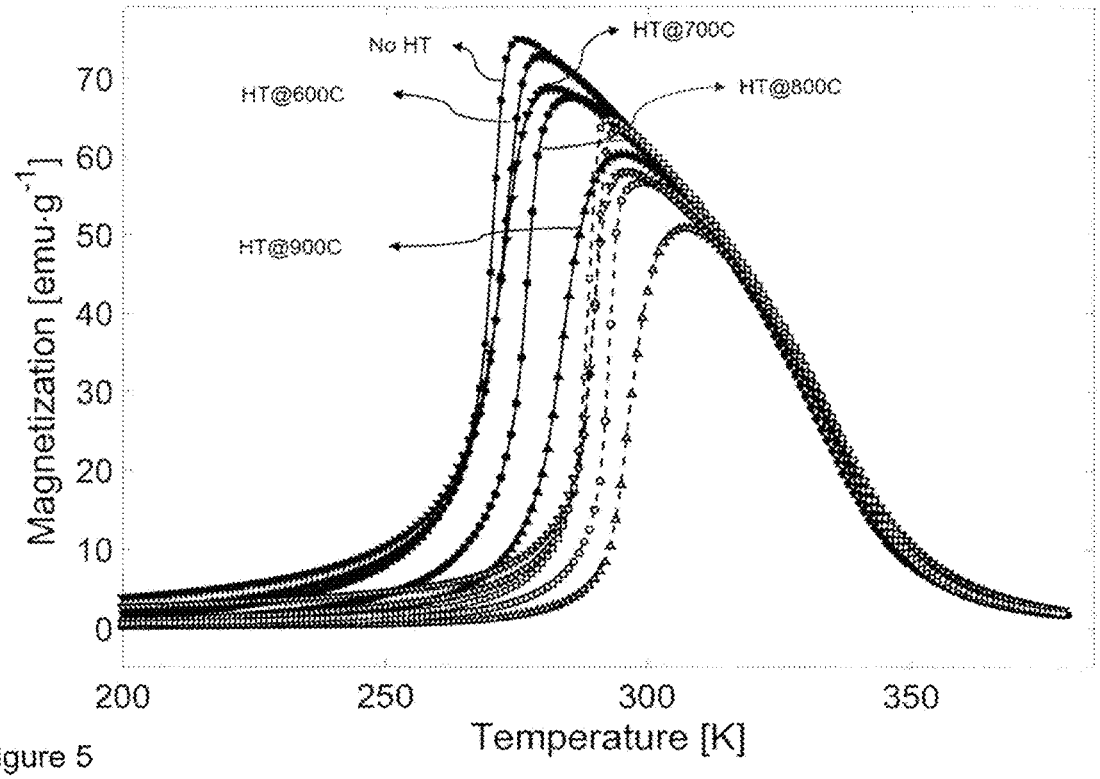
FIG. 5 shows isofield magnetization measurements of rapidly solidified by melt spinning $Ni_{37.5}Co_{12.5}Mn_{35}Ti_{15}$ ribbons without heat treatment ("no HT") and with heat treatments ("HT") at different temperatures (as shown) for 30 min, measured at a constant magnetic field of 0.1 T. Filled symbols show magnetization measured during cooling, and open symbols show magnetization measured during heating.

FIG. 5 shows the effect of heat treatment (HT) on the magnetization of $Ni_{37.5}Co_{12.5}Mn_{35}Ti_{15}$. As one may see, HT leads to the increase of $T_M$ while maintaining the $T_C$ constant. This relation could be due to the relaxation of internal stresses that remained in the ribbons after being melt-spun, as EDX and SEM analyses (of a sample HT at 700° C.) have not shown chemical or microstructural change.

Figure 6:
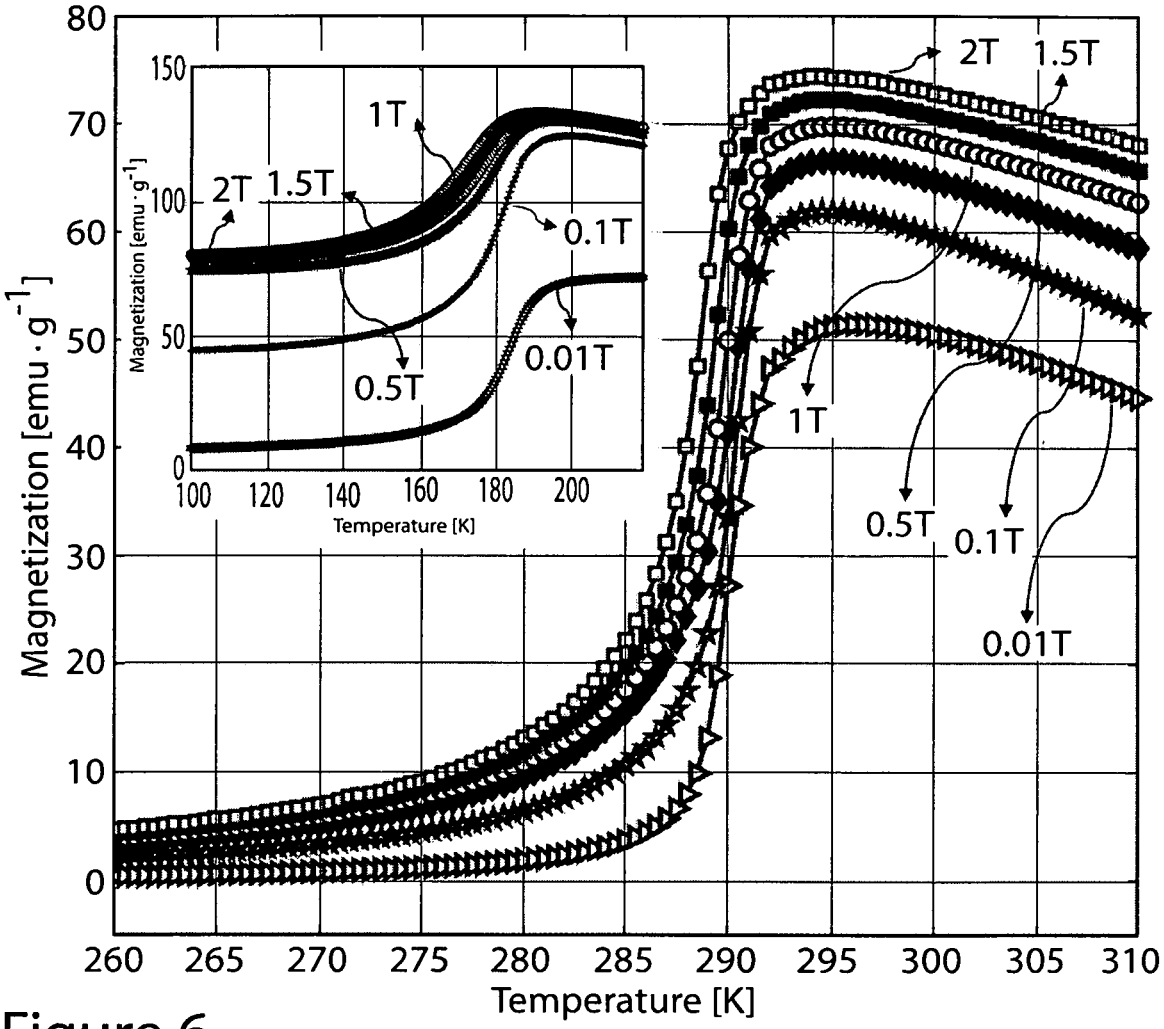
FIG. 6 shows isofield magnetization measurements of rapidly solidified by melt spinning $Ni_{37.5}Co_{12}0.5Mn_{35}Ti_{15}$ ribbons performed at different applied magnetic fields during heating. The inset shows isofield magnetization curves of $Ni_{35}Co_{15}Mn_{35}Ti_{15}$.

FIG. 6 shows magnetization measurements at different applied fields for as-melt-spun ribbons of $Ni_{37.5}$ $Co_{12.5}Mn_{35}Ti_{15}$. As one may notice, the sharpness of the transition barely changes, which indicates a strong first order phase transition, whereas the inset in FIG. 6 shows that for $Ni_{35}Co_{15}Mn_{35}Ti_{15}$ the sharpness decreases with the increasing magnetic field. Moreover, the shift of transition temperature with magnetic field $dT_M/dH$ was 0.78±0.23 $K \cdot T^{-1}$.

For the $Ni_{36.3}$ $Co_{13.7}Mn_{35}Ti_{15}$ composition, $dT_M/dH$ was 1.62±0.31 $K \cdot T^{-1}$, and for the $Ni_{35}Co_{15}Mn_{35}Ti_{15}$ composition, $dT_M/dH$ was 5.02±0.26 $K \cdot T^{-1}$, although these data are not shown. According to the Clausius-Clapeyron equation, the smaller is the transition shift with field, i.e. ($dT_M/dH$), the larger is the first order contribution to the entropy change [reference 10].

Figure 7:
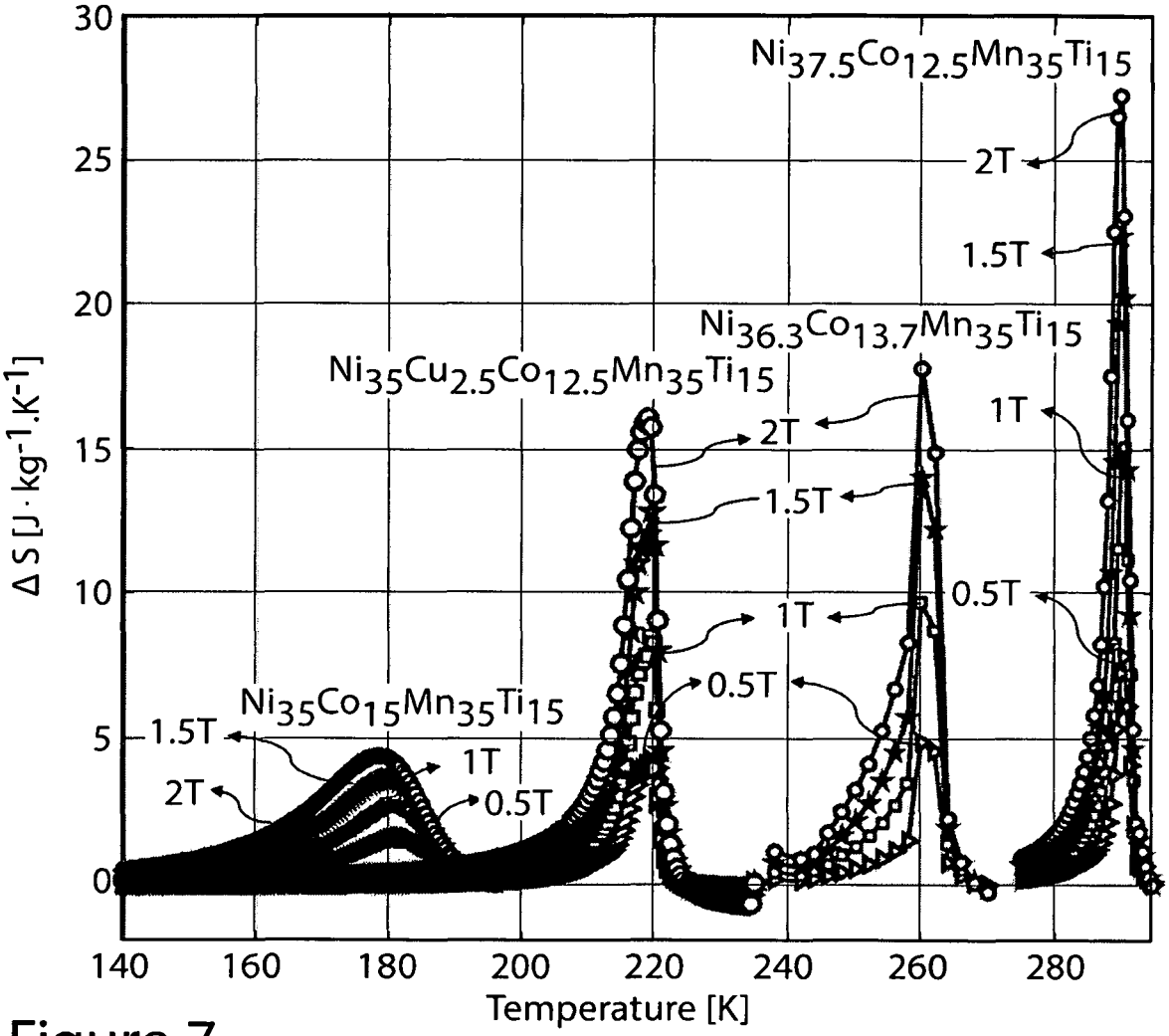
FIG. 7 shows entropy changes, i.e., magnetocaloric effects, as a functions of temperature for different magnetic field changes and different alloy compositions.

Indeed, FIG. 7 shows the entropy change for different compositions without heat treatments, where it is observed that there is a significant decrease of the entropy change with the increase of Co content in $Ni_{50-x}$ $Co_xMn_{35}Ti_{15}$. This is highly influenced by the decrease of the transition sharpness with Co content, as well as with the increased magnetization of the AFM (antiferromagnetic transition), as it is shown in the inset of FIG. 6 for the $Ni_{35}Co_{15}Mn_{35}Ti_{15}$ composition. The inset in FIG. 8 also shows a comparison of magnetic entropy changes of a sample without heat treatment and a sample heat treated at 1073 K for 30 minutes. The heat treatment allowed fine tuning of the transition temperature; however, the HT has decreased the magnetocaloric effect (the entropy change) as well. Therefore, it appears that compositional adjustment may be a better way to control the transition temperature in this material.

The substitution of Cu in Ni has a smaller effect on the transition sharpness. Therefore, a large magnetocaloric effect is retained at lower temperatures, where for $Ni_{35}Cu_{2.5}Co_{12.5}Mn_{35}$ $Ti_{15}$, the $T_M$ during heating is about 216 K (Table 2 above). This leads to a temperature range of at least 70 K where the martensitic transition temperature ($T_M$) is highly tunable and there is a large magnetocaloric effect.

Figure 8:
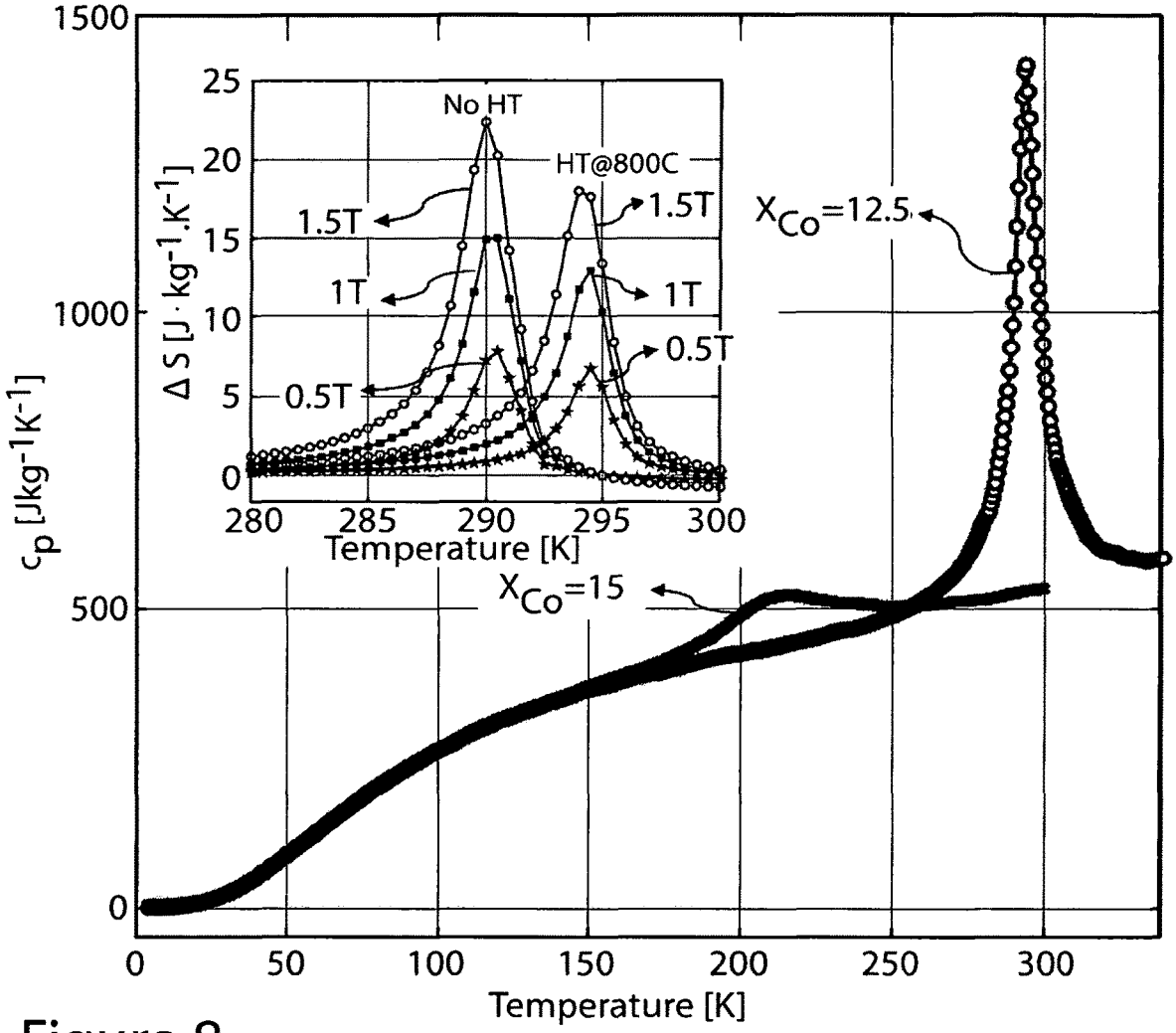
FIG. 8 shows heat capacities as functions of temperature at 0 T for two compositions of conventionally prepared by arc-melting bulk $Ni_{50-x}\ Co_xMn_{35}Ti_{15}$ with x=12.5 and x=15. The inset shows the entropy changes as functions of temperature at different magnetic field changes of $Ni_{37.5}Co_{12.5}Mn_{35}Ti_{15}$ without heat treatment (No HT) and heat-treated (HT) at 800 degrees C. for 30 minutes.

FIG. 8 shows the heat capacity of two samples, $Ni_{35}Co_{15}Mn_{35}Ti_{15}$ and $Ni_{37.5}Co_{12.5}Mn_{35}Ti_{15}$. The calorimetric measurement method requires bulk samples [reference 11]; therefore bulk samples heat treated at 1073 K for 7 days were used for these measurements. The latent heat involved in the martensitic transition of the $Ni_{37.5}Co_{12.5}Mn_{35}Ti_{15}$ composition was 13.1 $kJ \cdot kg^{-1}$ while that in $Ni_{35}Co_{15}Mn_{35}Ti_{15}$ composition was 2.3 $kJ \cdot kg^{-1}$. This is a further indication of the previous conclusion made from the Clausius-Clapeyron equation, which indicated that $Ni_{37.5}Co_{12.5}Mn_{35}Ti_{15}$ has a larger first order contribution to the magnetic field-induced entropy change when compared to $Ni_{35}Co_{15}Mn_{35}Ti_{15}$.

Figure 9:
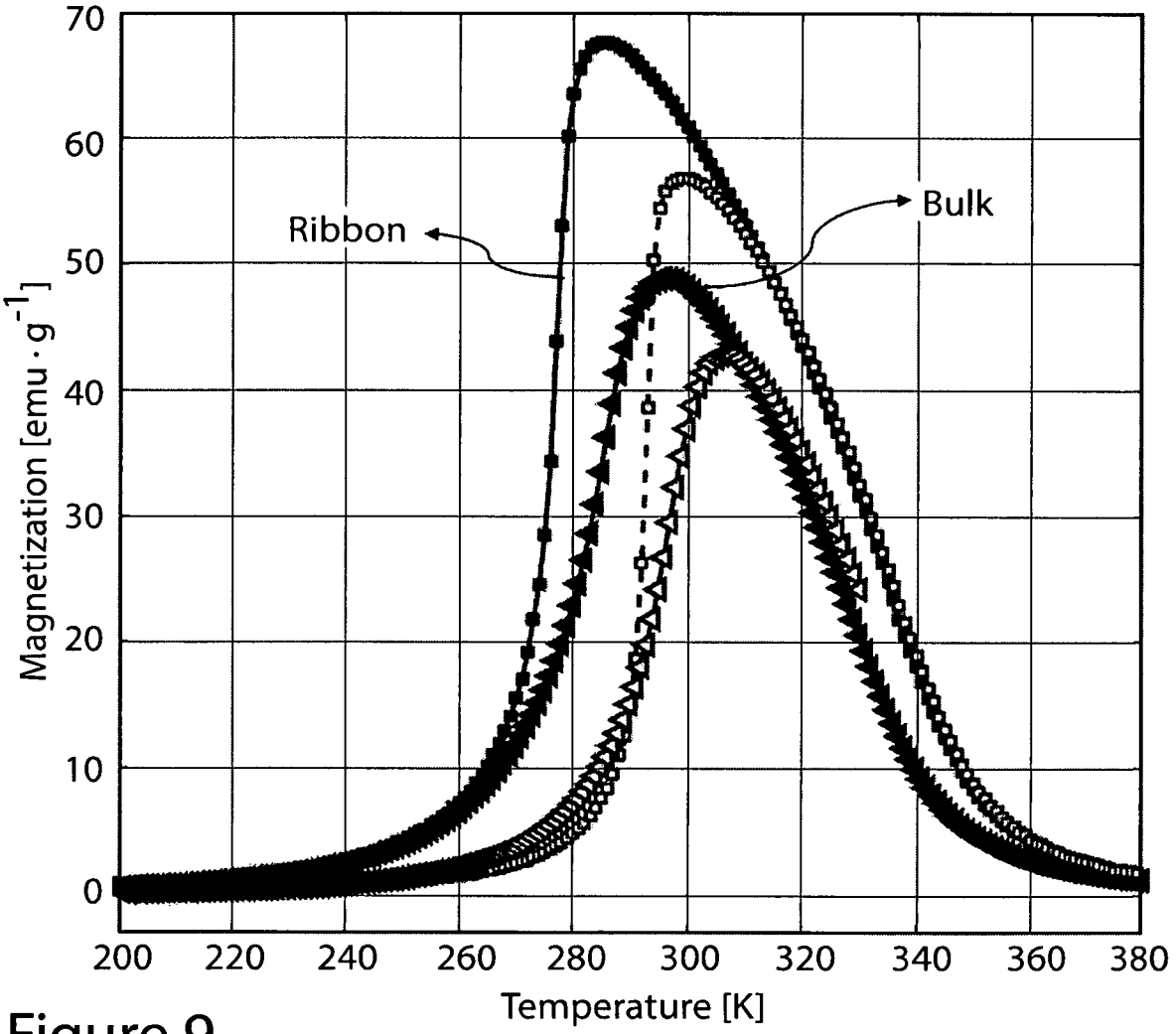
FIG. 9 shows comparison of isofield magnetization measurements of rapidly solidified by melt spinning ribbon samples and conventionally prepared by arc-melting bulk samples of $Ni_{37.5}Co_{12.5}Mn_{35}Ti_{15}$ at 0.1 T. Filled symbols show magnetization measured during cooling, and open symbols show magnetization measured during heating.
Figure 11:
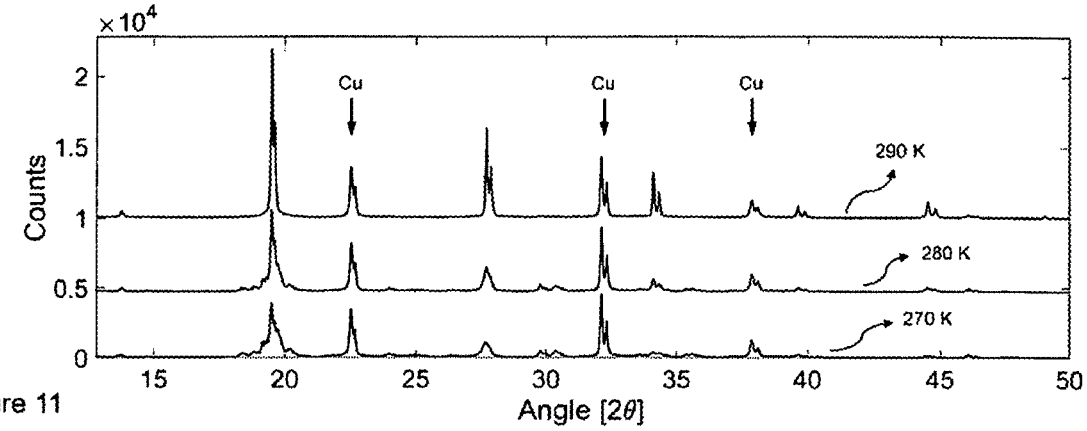
FIG. 11 shows x-ray diffraction (XRD) patterns measured at different temperatures temperature across the martensitic transition of rapidly solidified by melt spinning $Ni_{37.5}Co_{12.5}Mn_{35}Ti_{15}$. The Bragg peaks from the copper sample holder that retain the same intensity and do not change are marked with vertical arrows.

FIG. 11 shows XRD measurements as a function of temperature across the martensitic transition of the as-melt spun $Ni_{37.5}Co_{12.5}$ $Mn_{35}Ti_{15}$ composition. The peaks, that retain the same intensity and do not change, are from the copper sample holder. FIG. 9 confirms that a change of the crystal structure occurs at $T_M$, which for this material is approximately 280 K on cooling.

FIG. 9 shows a comparison of isofield magnetization measurements of ribbon samples and bulk samples of $Ni_{37.5}Co_{12.5}Mn_{35}Ti_{15}$ at 0.1 T wherein the phase transitions are much sharper in the ribbon samples when compared to the bulk samples.

Figure 10:
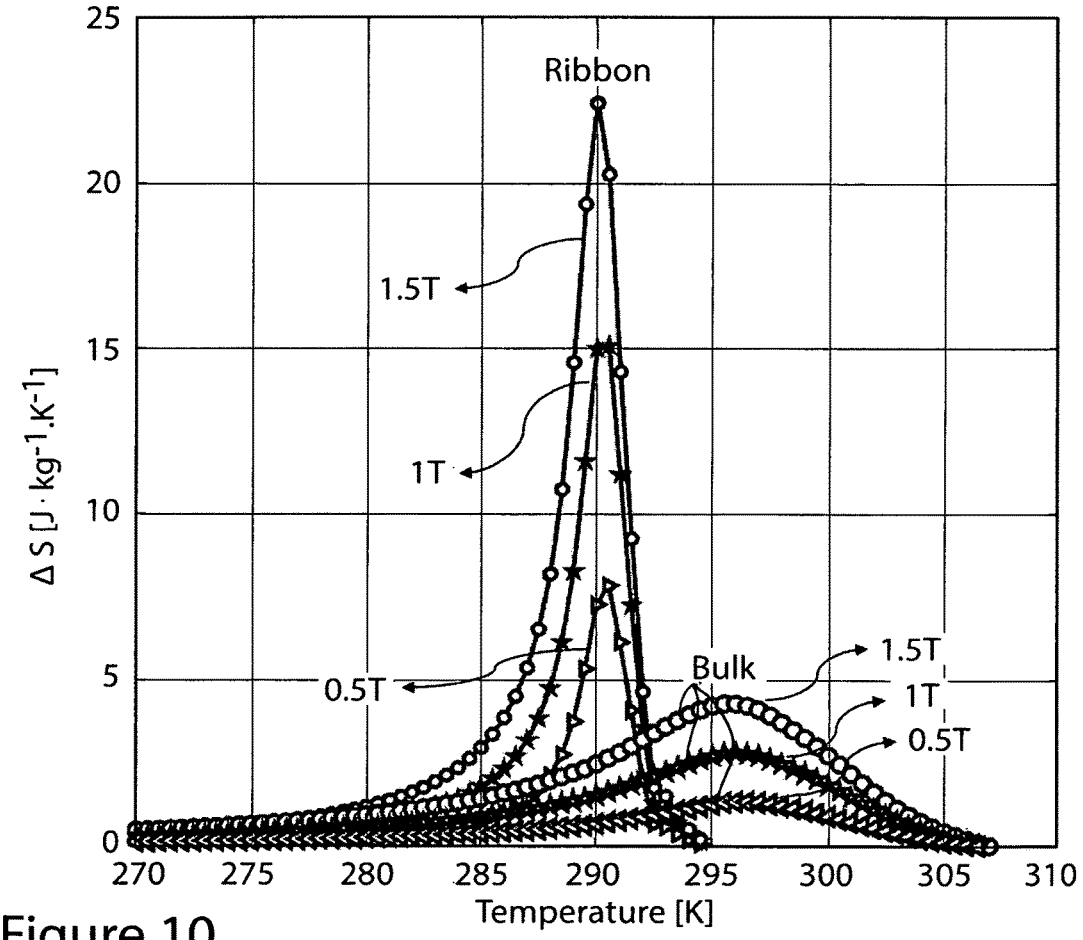
FIG. 10 shows entropy changes, i.e., magnetocaloric effects, as functions of temperature for different magnetic field changes of rapidly solidified by melt spinning ribbon samples and conventionally prepared by arc-melting bulk samples of $Ni_{37.5}Co_{12.5}Mn_{35}Ti$ s.

FIG. 10 shows the temperature dependence of AS for bulk sample and ribbon sample of $Ni_{37.5}Co_{12.5}Mn_{35}Ti_{15}$ at several magnetic field changes. This figure demonstrates dramatically enhanced magnetocaloric effect in rapidly solidified $Ni_{37.5}Co_{12.5}Mn_{35}Ti_{15}$ samples. The resulting magnetic entropy changes (AS) exceed those observed in conventionally prepared (arc-melted) bulk samples (reference 7) by as much as 300% or more, such as 400% when compared to the aforementioned bulk comparative sample prepared by the inventors by conventional melting and heat treatment, wherein the ribbon sample reached as much as 27 $J \cdot kg^{-1} \cdot K^{-1}$ for a 2T magnetic field change around room temperature.

This large MCE is on a par with the best magnetocaloric materials available at present. Moreover, the rapidly solidified (melt-spun) ribbons were ductile and remained mechanically intact during cycling though the phase transition. Their phase transitions are much sharper in ribbon samples when compared with the phase transitions of bulk (arc-melted) counterpart samples. Further, their phase transition temperatures and their magnetocaloric effects can be controlled by chemical substitution as described here below.

In contrast to the results discussed above, the composition $Ni_{35}Co_{15}Mn_{35}Ti_{15}$ (prepared by conventional methods as described in reference 7) showed a maximum value of entropy change of about 10 $J \cdot kg^{-1} \cdot K^{-1}$ at approximately 275 K for a field change of 2 T and presented a large volume change of about 2% derived from the parent B2 (austenitic) phase and martensitic phase.

Figure 12:
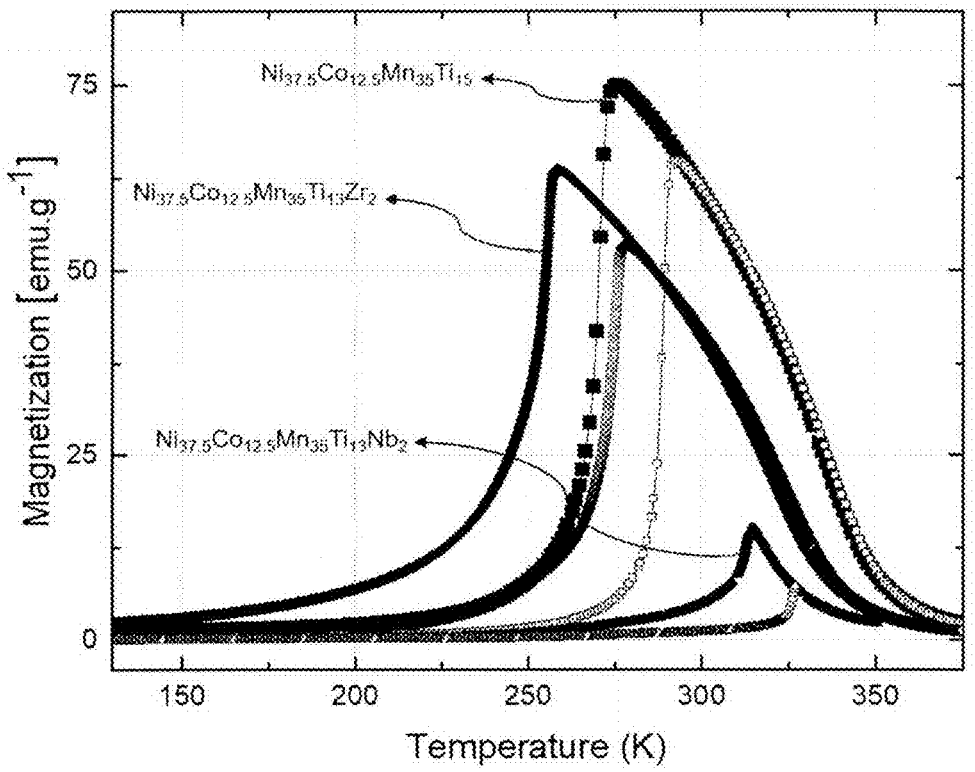
FIG. 12 show isofield magnetization measurements of different compositions of rapidly solidified by melt spinning $Ni_{37.5}Co_{12.5}Mn_{35}Ti_{15}$ and $Ni_{37.5}Co_{12.5}Mn_{35}Ti_{13}Z_2$ ribbons where Z=Nb or Zr) measured at a constant magnetic field of 0.1 T. Filled symbols show magnetization measured during cooling, and open symbols show magnetization measured during heating.

FIG. 12 shows that substituting Ti by Nb in $Ni_{35}Co_{12.5}Mn_{35}Ti_{15-y}Nb_y$ has an effect similar to that when the concentration of Co is reduced from 12.5 to 11 (see FIG. 1). But when Ti is replaced with Zr in $Ni_{35}Co_{12.5}Mn_{35}Ti_{15-y}Zr_y$, the effect is similar to that when the concentration of Co is increased from 12.5 to 13.7. This shows that the transition temperature and the magnetocaloric effect can be further controlled and adjusted by these chemical modifications.

Figure 13:
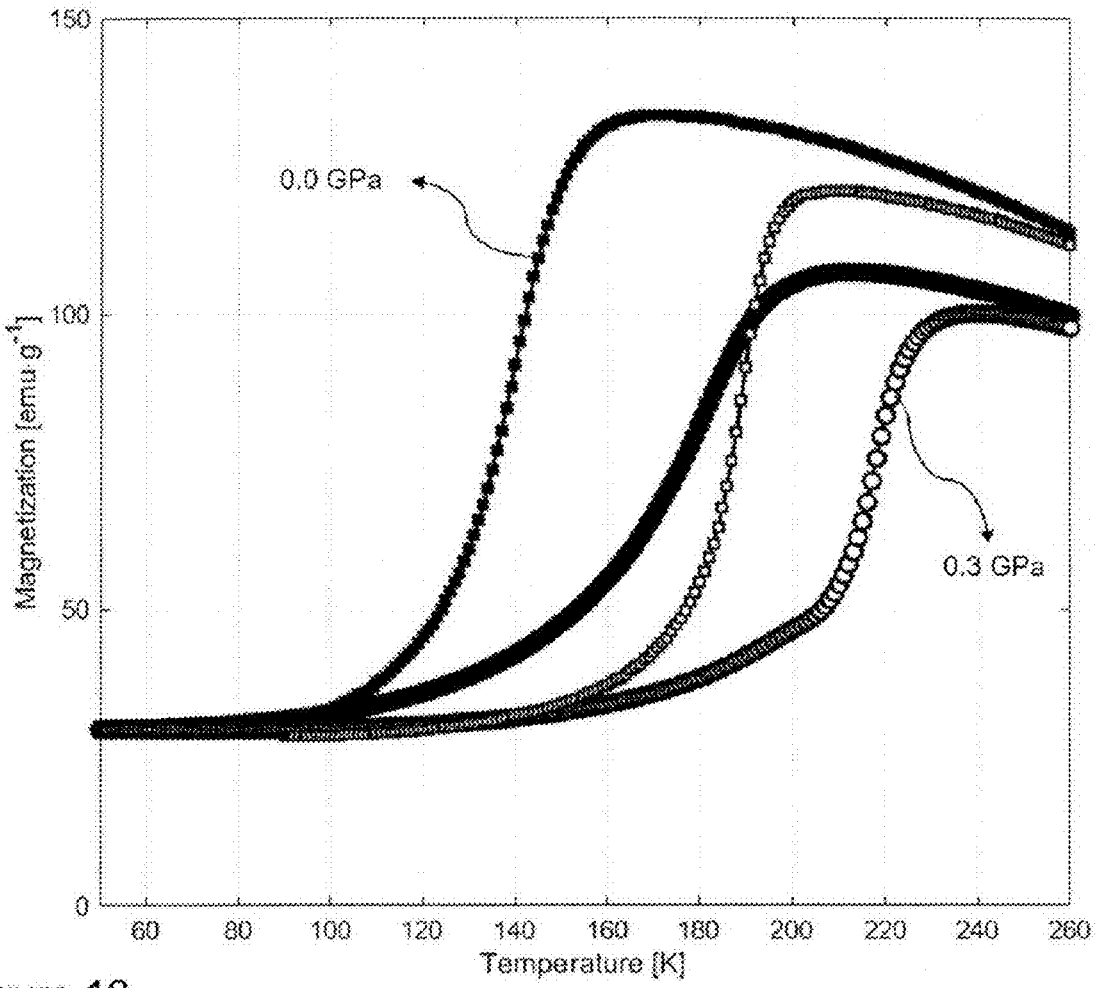
FIG. 13 shows isofield magnetization measurements for rapidly solidified by melt spinning $Ni_{35}Co_{15}Mn_{35}Ti_{15}$ ribbon samples at 0 and 0.3 GPa hydrostatic pressure. Filled symbols show magnetization measured during cooling, and open symbols show magnetization measured during heating.

Referring to FIG. 13, isofield magnetization measurements for $Ni_{35}Co_{15}Mn_{35}Ti_{15}$ ribbon sample at 0 and 0.3 GPa hydrostatic pressure are shown. FIG. 13 reveals that the hysteresis of the $Ni_{35}Co_{15}Mn_{35}Ti_{15}$ sample could be controlled by application of hydrostatic pressure. Magnetization measurements under hydrostatic pressure were performed using a Cu—Be pressure cell and Daphne 7373 fluid as the pressure medium.

The pressure cell was placed in a superconducting quantum interference device (SQUID) magnetometer (by Quantum Design, USA), where the measurements were carried out in the temperature interval of 50-320 K and in magnetic field of 1 kOe. The pressure was determined by observing the shift of the superconducting critical temperature of a high-purity Pb sample that had been placed together with the $Ni_{35}Co_{15}Mn_{35}Ti_{15}$ sample in the pressure cell.

The examples demonstrate giant magnetocaloric effects for $Ni_{50-x}$ $Co_xMn_{35}Ti_{15}$ ribbon samples near room temperature for relatively low magnetic fields. The observed peak values of AS for the rapidly solidified samples were enhanced surprisingly by 400% compared to their bulk counterpart samples, were larger than most magnetocaloric materials reported for near room-temperature applications, and the materials retained mechanical stability even during the structural transition as evidenced by physical integrity of the samples after several thermal cycles, thereby providing advanced magnetocaloric materials for viable room-temperature applications such as magnetocaloric refrigeration.

The present invention provides a method for the fabrication through a rapid solidification method of d-element alloys with large magnetocaloric effects and highly tunable transition temperatures, and provides more adequate materials to achieve commercialization and efficient products for magnetic cooling and heat pumping application. Adjusting the martensitic-austenitic transition temperature is easily done by stoichiometric control of the composition with retained transition sharpness. Moreover, if one wants to finely tune the transition, this may be done by short time (for example, 30 min) heat treatments at different temperatures. The materials described herein show excellent mechanical integrity and an observed magnetic entropy change as high as 27 $J \cdot kg^{-1} \cdot K^{-1}$ around room temperature for a magnetic field change of 2 T.

Practice of embodiments of the present invention also provide a magnetic regenerator comprising multiple components, such as two or more layers of packed particulates, packed spheres, stacked sheets, and/or stacked plates having the same composition, but annealed at different temperatures to provide different magneto-structural transition temperatures for use in the operation of the regenerator. Also envisioned is a magnetic regenerator having two or more components of different substituted alloy compositions, such as those set forth below, to provide different magneto-structural transition temperatures for use in the operation of the regenerator.

Materials made by practice of the present invention in particulate form, such as powders, ribbon segments, etc. can be mixed with metallic or polymeric binders to fabricate composite materials for use as regenerators of a magnetic refrigerator.

Although the present invention is described above with respect to certain illustrative embodiments, the invention is not limited to these embodiments and changes and modifications can be made therein within the scope of the appended claims.

REFERENCES WHICH ARE INCORPORATED HEREIN BY REFERENCE

[1] A. Smith, C. R. H. Bahl, R. Bjørk, K. Engelbrecht, K. K. Nielsen, N. Pryds, Materials Challenges for High Performance Magnetocaloric Refrigeration Devices, Adv. Energy Mater. 2 (2012) 1288-1318. doi:10.1002/aenm.201200167.

[2] G. V. Brown, Magnetic heat pumping near room temperature, J. Appl. Phys. 47 (1976) 3673. doi:10.1063/1.323176.

[3] V. K. Pecharsky, K. A. Gschneidner, Jr., Giant Magnetocaloric Effect in $Gd_5Si_2Ge_2$, Phys. Rev. Lett. 78 (1997) 4494-4497. doi: 10.1103/PhysRevLett.78.4494.

[4] S. Fujieda, a. Fujita, K. Fukamichi, Y. Yamazaki, Y. Iijima, Giant isotropic magnetostriction of itinerant-electron metamagnetic $La(Fe_{0.88}Si_{0.12})_{13}H_y$ compounds, Appl. Phys. Lett. 79 (2001) 653. doi:10.1063/1.1388157.

[5] O. Tegus, E. Brück, K. H. J. Buschow, F. R. de Boer, Transition-metal-based magnetic refrigerants for room-temperature applications, Nature. 415 (2002) 150-152. doi:10.1038/415150a.

[6] A. K. Pathak, I. Dubenko, Y. Xiong, P. W. Adams, S. Stadler, N. All, Effect of partial substitution of Ni by Co on the magnetic and magnetocaloric properties of $Ni_{50}Mn_{35}In_{15}$ Heusler alloy, J. Appl. Phys. 109 (2011) 07A916. doi:10.1063/1.3540696.

[7] Z. Y. Wei, E. K. Liu, J. H. Chen, Y: Li, G. D. Liu, H. Z. Luo, X. K. Xi, H. W. Zhang, W. H. Wang, G. H. Wu, Realization of multifunctional shape-memory ferromagnets in all-d-metal Heusler phases, Appl. Phys. Lett. 107 (2015) 11-16. doi: 10.1063/1.4927058.

[8] H. N. Bez, K. K. Nielsen, A. Smith, C. R. H. Bahl, A detailed study of the hysteresis in $La_{0.67}Ca_{0.33}MnO_3$, J. Magn. Magn. Mater. 416 (2016) 429-433. doi:10.1016/j.jmmm.2016.05.011.

[9] A. P. Holm, V. K. Pecharsky, K. A. Gschneidner, R. Rink, M. N. Jirmanus, X-ray powder diffractometer for in situ structural studies in magnetic fields from 0 to 35 kOe between 2.2 and 315 K, Rev. Sci. Instrum. 75 (2004) 1081-1088. doi: 10.1063/1.1667253.

[10] E. Lovell, H. N. Bez, D. C. Boldrin, K. K. Nielsen, A. Smith, C. R. H. Bahl, L. F. Cohen, The $La(Fe,Mn,Si)_{13}H_z$ magnetic phase transition under pressure, Phys. Status Solidi—Rapid Res. Lett. 1700143 (2017) 1700143. doi: 10.1002/pssr.201700143.

[11] V. K. Pecharsky, J. O. Moorman, K. A. Gschneidner, A 3-350 K fast automatic small sample calorimeter, Rev. Sci. Instrum. 68 (1997) 4196. doi: 10.1063/1.1148367.

We claim:

1. A method of making a magnetocaloric alloy composition comprising Ni, Co, Mn, and Ti alloy represented by $Ni_{50-x}Co_xMn_{35}Ti_{15}$ where x=10 to 15 comprising melting the alloy to provide an alloy melt and rapidly solidifying the alloy melt at a cooling rate of at least 100 K/second (Kelvin/second) to yield a rapidly solidified alloy having a B2 crystal structure and exhibiting a magneto-structural transition between a ferromagnetic phase and an antiferromagnetic phase that produces, as-rapidly solidified, a magnetocaloric entropy change at about room temperature in a magnetic field of 1.5 T to 2 T that is greater than that of a same alloy that is not rapidly solidified.

2. The method of claim 1 wherein the alloy melt is rapidly solidified by melt spinning, splat quenching, gas atomization, selective laser melting, or 3D printing.

3. The method of claim 1 including the further step of heat treating the rapidly solidified alloy to homogenize the alloy composition.

4. The method of claim 1 including the further step of annealing the rapidly solidified alloy at a temperature and for a time to adjust a magneto-structural transition temperature.

5. The method of claim 1 wherein the rapidly solidified alloy exhibits a chemically homogeneous microstructure or nanostructure.

6. The method of claim 1 that produces the rapidly solidified alloy that exhibits a magnetocaloric entropy change at room temperature in a magnetic field of 1.5 T to 2 T that is about three times or more greater than that of a same alloy that is arc-melted and heat treated bulk alloy.

* * * * *